United States Patent [19]

Fletcher et al.

[11] 3,957,044

[45] May 18, 1976

[54] SELF-CONTAINED BREATHING APPARATUS

[76] Inventors: James C. Fletcher, Administrator of the National Aeronautics and Space Administration, with respect to an invention of John L. Sullivan, Fort Erie, Canada; Eugene A. Giorgini, Cheektowaga; Milo R. Simmonds, Williamsville, both of N.Y.

[22] Filed: Nov. 11, 1974

[21] Appl. No.: 522,971

[52] U.S. Cl. ..... 128/142.2; 128/203; 137/DIG. 9; 137/110

[51] Int. Cl.[2] ..... A62B 7/04

[58] Field of Search ..... 128/142.2, 142, 142.3, 128/142.4, 145.8, 145.5, 145.6, 146.4, 188, 203, 191 R, DIG. 17; 137/110, DIG. 9

[56] References Cited

UNITED STATES PATENTS

| | | | |
|---|---|---|---|
| 2,854,001 | 9/1958 | Humblet | 128/142.2 |
| 3,190,287 | 6/1965 | Miller, Jr. | 137/DIG. 9 |
| 3,481,356 | 12/1969 | McQueen | 137/110 |
| 3,508,542 | 4/1970 | Browner | 128/142.2 |
| 3,742,972 | 7/1973 | Hughes | 137/110 |

*Primary Examiner*—Robert W. Michell
*Assistant Examiner*—Henry J. Recla
*Attorney, Agent, or Firm*—Marvin J. Marnock; John R. Manning; Marvin F. Matthews

[57] ABSTRACT

A Self-Contained Breathing Apparatus with automatic redundant fluid pressure controls and a facemask mounted low pressure warning device. The apparatus utilizes two stages of pressure regulation wherein the final stage is the demand regulator that delivers the breathing gas to the wearer. The first state includes a pair of pressure regulators connected in parallel with different outlet pressures, both of which reduce the pressure of the stored supply gas to pressures compatible with the second stage breathing demand regulator. A primary regulator in the first stage delivers a low output pressure to the second stage demand regulator. In the event of a "failure closed" condition of the primary regulator an automatic transfer valve switches on the backup regulator and communicates its slightly higher outlet pressure to the demand regulator. A warning that the supply pressure has been depleted to a predetermined low level is also provided by a supply pressure actuated transfer valve which transfers the output of the first stage pressure regulators from the primary to the backup regulator thereby activating a whistle alarm device in the facemask to which the demand regulator is also mounted. The whistle is activated by the higher outlet pressure from the backup regulator during the inhalation phase of each breath in either of the two events of a "failure closed" condition of the primary regulator or the depletion of the supply pressure to a dangerously low level.

3 Claims, 1 Drawing Figure

SELF-CONTAINED BREATHING APPARATUS

ORIGIN OF THE INVENTION

The invention described herein was made in the performance of work under a NASA contract and is subject to the provisions of Section 305 of the National Aeronautics and Space Act of 1958, Public Law 85-568 (72 Stat. 435; 45 U.S.C. 2457).

BACKGROUND OF THE INVENTION

In self-contained breathing apparatus, used for respiratory protection in hazardous atmospheres and which include a supply of air or oxygen, hand operated valves are frequently used to provide the extra margin of safety against failure of the breathing gas supply. Such failures might be "failure closed" of the supply regulator valves or "failure open" that would lead to premature loss of the breathing gas. In order for the hand valves to be effective as a backup system, it is essential that the user be properly trained in their use, that he not panic as a result of the primary malfunction, and that his hands are free to operate the valves.

In the previously mentioned breathing apparatus a warning system is usually provided to warn when the breathing gas has been depleted to a pre-established level. In most of these systems, a depleted pressure supply causes the operation of an electrical signal device or a fluid-actuated alarm device such as a whistle or bell wherein the fluid which operates the alarm is wastefully exhausted to the outside atmosphere.

SUMMARY OF THE INVENTION

This invention relates to a self-contained breathing apparatus with a facemask respirator used for respiratory protection during entry into and escape from hazardous atmospheres. The system is provided with automatic redundant fluid pressure controls for delivering the breathing gas to the wearer of the apparatus. A pair of first stage pressure regulators connected in parallel between the gas supply container and the second stage breathing demand regulator which delivers the breathing gas to the wearer serve to reduce the pressure of the stored gas to outlet pressures compatible with the breathing regulator. One of the first stage regulators is a primary regulator which provides a low output pressure to the breathing regulator. The other first stage regulator is a backup regulator which provides an outlet pressure higher than the low outlet pressure of the primary regulator but is normally closed from fluid communication with the breathing regulator. In the event of a failure closed condition of the primary regulator, an automatic transfer valve operates to switch on the backup regulator to communicate its higher outlet pressure to the breathing regulator. A pressure actuated transfer valve also serves to transfer the outlet pressure of the backup regulator to the breathing regulator when the supply pressure has been depleted to a predetermined dangerously low level. A fluid actuated whistle alarm mounted in the facemask operates during the inhalation phase of each breath whenever the outlet pressure of the backup regulator is communicated to the respirator. The alarm is activated during inhalations in either of the two events of a failure closed condition of the primary regulator or a depletion of the supply of breathing gas to a dangerously low level.

BRIEF DESCRIPTION OF DRAWING

The single FIGURE of the drawing is a schematic diagram of a preferred embodiment of the invention.

DESCRIPTION OF PREFERRED EMBODIMENT

Figure 1:
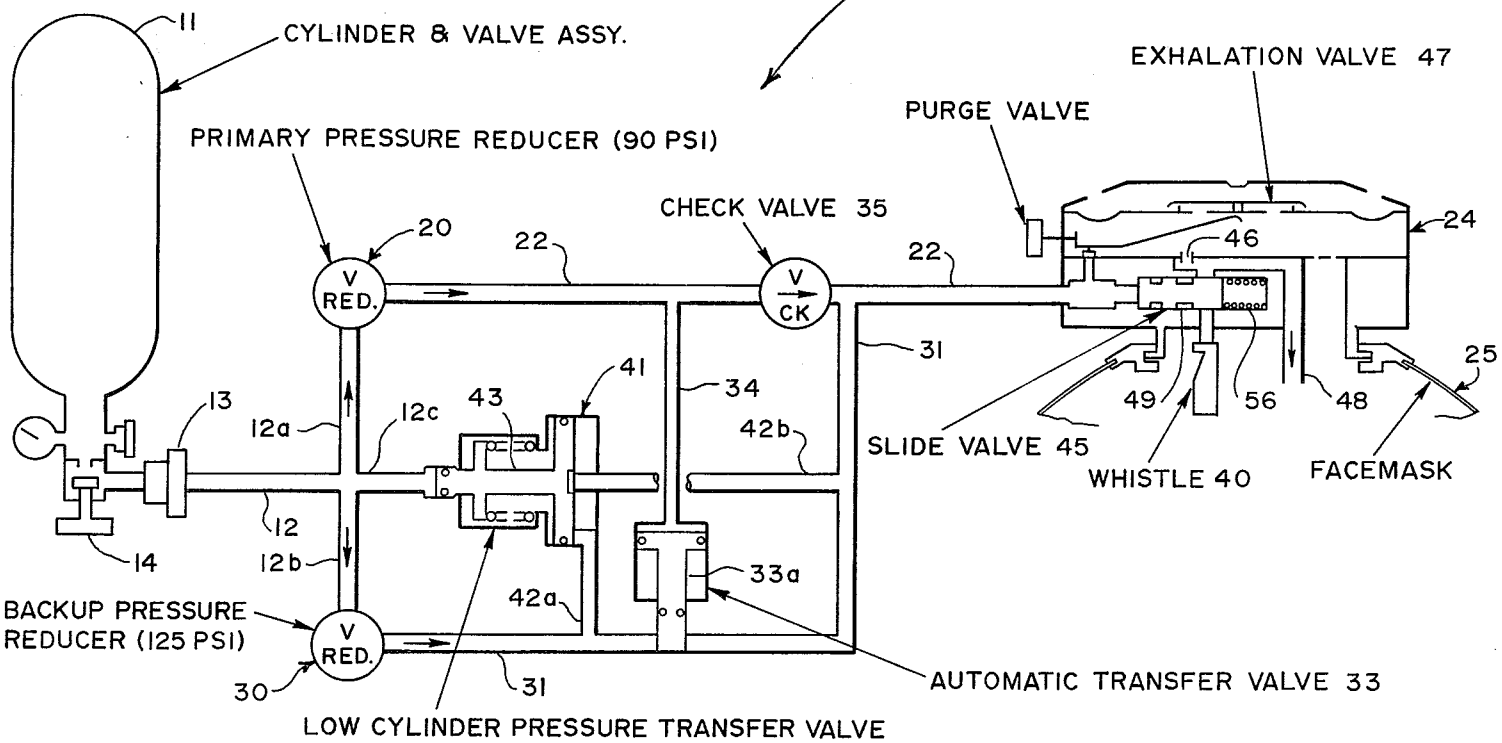

In the drawing, a preferred embodiment of the self-contained breathing apparatus 10 of this invention is disclosed. The apparatus is supplied with a breathing gas such as air or oxygen from a pressure vessel 11 which is preferably a lightweight filament wound composite pressure vessel and which initially supplies a fluid pressure of approximately 4500 p.s.i.g. The outlet of the gas supply cylinder is connectable to a conduit 12 through a conventional coupling 13. When the outlet valve 14 of the supply container is opened, the supply pressure is communicated through the high pressure conduit 12 and branch conduit **12*a* to a primary pressure regulator 20 of conventional type. The primary pressure regulator 20 delivers a constant low outlet pressure of 90 psi to a conduit 22 which is in fluid communication with a conventional demand regulator 24 attached to the facemask respirator 25.**

A backup pressure regulator 30 is also connected to the high pressure conduit 12 through the conduit branch 12b. The backup pressure regulator delivers a constant outlet pressure of 125 psi to a conduit 31, coupled at one end to the outlet of the regulator 30 and at its other end to the conduit 22. An automatic transfer valve 33 is coupled in fluid communication with the conduit 31 and to the conduit 22 by means of a conduit 34. The conduit 34 connects with the conduit 22 at a junction between the primary regulator 20 and the junction of the conduits 31 and 22.

The transfer valve 33 normally closes off the conduit 31 from fluid communication with the conduit 22. A slide valve element 33a in the valve 33 is biased in the position which closes off the conduit 31 by the application of the 90 psi pressure from the primary regulator to a surface area of the valve element **33*a*** which is larger than the surface area on which the 125 psi pressure is applied. A coil spring biasing means (not shown) might also be employed in combination with the 90 psi to overcome the 125 psi. However, any conventional valves actuated by a pressure differential might be employed.

In the event of a failure of the primary regulator 20 which would close off its fluid communication with the breathing regulator and facemask respirator, the transfer valve 33 is opened by the action of the 125 psi fluid in the conduit 31 and the difference in opposing forces acting on the valve element **33*a* to communicate the fluid from the backup pressure regulator 30 to the breathing regulator. A check valve 35 located in the conduit 22 between the junctions with the conduits 31 and 34 and which permits fluid flow in the direction towards the demand regulator, serves to prevent communication of the backup regulator outlet pressure with the conduit 34 and a consequent intermittent or oscillatory operation of the transfer valve 33.** It will therefore be seen that a redundant pressure regulated supply line of breathing gas to the demand regulator is provided which is operative to supply breathing gas to the wearer in the event the primary regulator should become clogged or otherwise rendered inoperative in a condition that would close off its outlet to the breathing regulator.

An alarm device in the form of a whistle 40 is mounted in the facemask and is responsive to the delivery of the 125 psi outlet pressure from the backup regulator to the breathing regulator to provide an audible signal during inhalations of the wearer whenever the backup regulator is providing the breathing gas. The whistle alarm also serves as a warning device to signal that the supply to breathing gas has been depleted to a dangerously low level. The operation of the alarm system is hereinafter described.

When the supply of breathing gas is depleted to a relatively low pressure level as, for example, 800 psi, a pressure transfer valve 41 is actuated to switch the pressure output to the breathing regulator from the primary to the backup regulator. The transfer valve 41 is coupled to the conduit 31 by a conduit 42*b* and is coupled to the high pressure conduit 12 by a conduit branch 12*c*. The conduit 42*a* joins the conduit 31 intermediate the outlet end of the regulator 30 and the transfer valve 33. The conduit 42*b* couples the transfer valve 41 to the conduit 31 at a point between the transfer valve 33 and the breathing regulator.

Although the application of the 125 psi outlet pressure of the backup regulator acts on a larger surface area of the moveable valve element 43 of the valve 41 than does the high pressure from the breathing gas supply, the transfer valve element is normally biased to the position which closes off communication between the conduits 42*a* and 42*b*. However, when the supply pressure drops below 800 psi, the 125 psi outlet pressure from the backup regulator which acts on the valve element 43 is sufficient to overcome the force acting on the valve element from the supply conduit 12c and the valve element is moved to open communication between the conduits 42*a* and 42*b*. In this occurrence, the 125 psi outlet pressure of the backup regulator is delivered to the breathing regulator on the facemask respirator. The check valve 35 in the conduit 22 prevents the 125 psi pressure being applied to the outlet of the primary regulator 20 and to the conduit 34 as this would likely cause a sporadic operation of the transfer valve 33.

The breathing regulator 24 is of a conventional type which delivers breathing gas to the wearer only during his inhalations. In the preferred embodiment, the breathing regulator is connected to the facemask by a quarter turn "quick-disconnect," which is utilized for convenience in donning and doffing the apparatus. A spray bar made up of a small duct with a plurality of small holes (not shown) is coupled to the outlet 46 of the breathing regulator for spraying the breathing gas onto the visor or eyepiece for the prevention of fogging on the visor of the facemask. As customary, the control element of the breathing regulator is arranged to sense and control the facemask cavity pressure. Exhaust from the facemask is through a flapper-type exhalation valve 47 mounted on the facemask in conventional manner.

In the preferred embodiment, the flow for the sound generator is obtained from the flow to the spray nozzle as the whistle is coupled in a flow passage 48 communicating with the spray nozzle. A slide valve element 45 is disposed in a cylinder communicatng with the conduit 22 in a position biased by the action of a coil spring 56 which normally closes off fluid flow to the whistle. However, when either of the transfer valves 33 or 41 operate to supply 125 psi fluid pressure to the breathing regulator, the slide valve is shifted against the biasing action of the spring 56 to open communication with the whistle 40 by means of an annular recess 49 about the valve element positioned to communicate the spray nozzle passage 48 with the whistle. The sound is generated only on inhalation and the gas passing through the whistle is available to the wearer rather than being wastefully exhausted to the ambient environment.

In a preferred embodiment, the gas supply cylinder and the pressure reducer assembly are carried on a frame and harness assembly whereby the greater part of the weight of the apparatus is carried on the hips. A very lightweight self-contained breathing apparatus is therefore represented by this invention which marks a significant improvement over the known prior art systems. The audible signal from the whistle is preferably at a signal intensity of 70 to 90 db at the ear of the user, with a frequency range of 500 to 4000 cps. By changing the cadence of his breathing, the wearer can differentiate between his warning and that of others who may be nearby. The warning sound is emitted when the gas supply is seriously depleted or if there is a failure of the primary reducer. In either case, the wearer is warned to proceed to a "safe" area.

What is claimed is:

1. A breathing apparatus with automatic redundant fluid pressure controls and a low pressure warning device, said apparatus comprising:

first and second conduit means, said first conduit means being adapted to be connected to a source supply of high fluid pressure;

a facemask respirator connected in fluid communication with said second conduit means;

first pressure reducer means interconnecting said first and second conduit means for delivering fluid at a first low pressure to said second conduit means and said respirator means;

third conduit means connected with said second conduit means;

second pressure reducer means interconnecting said first and third conduit means and operable to deliver fluid at an intermediate pressure higher than said first low pressure to said third conduit means;

first pressure transfer means normally closing said third conduit means and responsive to failure of said first pressure reducer means and a drop in pressure in said second conduit means to a predetermined level below said first low pressure to open said third conduit means and communicate fluid at the intermediate pressure to said second conduit means;

second pressure transfer means connected in fluid communication with said first and third conduit means and responsive to a pressure drop of said supply source below a predetermined dangerously low level of pressure to communicate fluid at said intermediate fluid pressure to said second conduit means; and fluid actuated alarm means mounted in said facemask respirator and responsive to delivery of fluid at said intermediate pressure to the respirator upon actuation of said first or second pressure transfer means to thereby signal an alarm and indicate a failure of said first pressure reducer means or the depletion of the gas supply to a dangerously low level.

2. A breathing apparatus as described in claim 1, wherein the facemask respirator includes a breathing demand regulator connected in fluid communication with the second conduit means and said alarm means is fluid actuated to signal an alarm only during the inhalations of a wearer of the facemask respirator.

3. A self-contained breathing apparatus with automatic redundant fluid pressure controls, said apparatus comprising:

a pair of first-stage pressure regulators;

a second-stage breathing regulator, said pair of first-stage pressure regulators including a first pressure regulator means and a backup regulator means connected in fluid communication with said second-stage breathing regulator and connectable in parallel between a gas supply container and the second-stage breathing regulator to reduce the pressure of the stored gas to pressures compatible with the second-stage breathing regulator, said first pressure regulator means producing a low output pressure and said backup regulator means producing an intermediate output pressure when connected to said gas supply;

first pressure transfer means responsive to a difference in pressures between said low and intermediate outlet pressures which is greater than a predetermined difference to thereby fluidly communicate said intermediate pressure to said second-stage breathing regulator in the event of failure of said first pressure regulator means to communicate said low output pressure;

second pressure transfer means responsive to a difference in pressure levels between said fluid pressure source and said intermediate outlet pressure which is less than a predetermined difference to thereby fluidly communicate said intermediate pressure to the breathing regulator in the event of depletion of the gas in said gas supply container to a predetermined low level;

a facemask respirator means, said breathing regulator being mounted in said facemask respirator means and providing breathing gas to the facemask respirator in response to inhalations of a wearer of the facemask respirator; and a fluid actuated signal device responsive to application of said intermediate pressure to the breathing regulator upon operation of either of said pressure transfer means to provide a warning during inhalations of the wearer in the event of failure of said first pressure regulator means or the depletion of gas in said gas supply container to a dangerously low pressure, said signal device being mounted within the facemask whereby the actuating fluid for said signal device is supplied as breathing gas to the wearer of the facemask respirator.

* * * * *